US006006899A

United States Patent [19]

McAuley et al.

[11] Patent Number: 6,006,899

[45] Date of Patent: *Dec. 28, 1999

[54] RING DISPLAY SYSTEM WITH ANTI-PILFERAGE RING TAG

[75] Inventors: William A. McAuley, Lincoln; Paul R. Stubblefield, Pawtucket, both of R.I.

[73] Assignee: K&M Associates, Providence, R.I.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/962,794

[22] Filed: Nov. 3, 1997

Related U.S. Application Data

[62] Division of application No. 08/368,108, Jan. 3, 1995, Pat. No. 5,720,498.

[51] Int. Cl.[6] ..... B65D 85/02

[52] U.S. Cl. ..... 206/6.1; 40/639; 206/566; 206/807

[58] Field of Search ..... 40/299, 639; 206/6.1, 206/566, 807; 211/4; 283/79, 81

[56] References Cited

U.S. PATENT DOCUMENTS

| | | | |
|---|---|---|---|
| 659,199 | 10/1900 | Anderton | 40/639 |
| 702,853 | 6/1902 | Angell | 40/566 |
| 840,487 | 1/1907 | Goldsmith | 40/639 |
| 857,778 | 6/1907 | Wittstein | 40/639 |
| 886,608 | 5/1908 | Jersemann | 206/566 |
| 899,778 | 9/1908 | Wittstein | 40/639 |
| 1,298,621 | 3/1919 | Wrigley . | |
| 1,528,720 | 3/1925 | Wittstein | 40/639 |
| 1,536,260 | 5/1925 | Dinhofer | 40/639 |
| 1,742,982 | 1/1930 | Wittstein | 40/639 |
| 4,074,637 | 2/1978 | Lorenzen, Jr. | 206/566 |
| 4,282,975 | 8/1981 | Ovadia | 206/566 |
| 4,865,352 | 9/1989 | Gollon | 283/79 |
| 4,880,117 | 11/1989 | Garganese | 206/6.1 |
| 5,535,878 | 7/1996 | Reed | 206/6.1 |

*Primary Examiner*—Jim Foster
*Attorney, Agent, or Firm*—Salter & Michaelson

[57] ABSTRACT

An anti-pilferage ring display system consists of a tag assembly which is attached to the shank of the ring and a display assembly for receiving the rings with the attached tag assemblies. The tag assembly includes an elongated, rigid card and a flexible, tear resistant strap for securing the card to the ring shank. A first end of the card includes an arcuate seat for receiving the ring shank in abutting relation. The strap is received through the shank of the ring wherein the first and second ends of the strap are secured to opposing surfaces of the card by means of pressure sensitive adhesive applied to the surfaces of the strap. The display assembly includes a pad having a plurality of slots for receiving the ring shanks and further includes a stand for supporting the slotted pad above a supporting surface. In use, the elongated card is passed through the slot so that the shank is received in the slot in a conventional manner. In this regard, the stand has a depth which is greater than the length of the elongated card so that the card can hang freely below the slotted pad when the ring shank is received in the slot.

13 Claims, 4 Drawing Sheets

RING DISPLAY SYSTEM WITH ANTI-PILFERAGE RING TAG

This application is a division of application Ser. No. 08/368,108 filed Jan. 3, 1995 which application is now: U.S. Pat. No. 5,720,498

BACKGROUND AND SUMMARY OF THE INVENTION

The instant invention relates to ring display systems and more particularly to a ring display system including an anti-pilferage ring tag.

It is well known in the jewelry art to display finger rings in a display assembly including a flocked or felt top pad having a plurality of spaced slits through which the ring shanks are inserted whereby the ornamental top portions of the rings are visible above the slitted pad. It is also well known to attach to the ring shank a small information tag, better known as a dumbbell tag, which folds around the shank of the ring and then is glued to itself. The tag is usually sized so that it fits within the ring shank opening whereupon it is substantially concealed when the ring shank is received in a slit in the pad. The tag typically includes style numbers and price information, etc. When a prospective purchaser wishes to try a ring on, the ring is removed from the pad in which it is mounted, and placed on a finger with the dumbbell tag still attached. The ring is then either purchased or returned to the display.

One of the major problems in display systems such as this is pilferage. Many people will try on a ring, and then if they like it and want to avoid paying for it, they simply rip the dumbbell tag off and put the ring on their finger and walk out of the store. One solution to the pilferage problem has been to provide ring displays with a plurality of locking bars which pass through the ring shanks when they are received in the display pad so that the rings cannot be removed from the display until a sales person operates the mechanism to unlock the bars. While effective in preventing pilferage, the repeated locking and unlocking of the display by a sales persons is undesirable.

In addition to the pilferage problem, when the rings are inserted into their display, the dumbbell tags will not often pass through the slitted pad and hence will be visible at the top of the pad, which creates a rather unsightly appearance to the overall display.

The instant invention overcomes the above problems by providing a ring display system comprising an anti-pilferage tag assembly and a display assembly for receiving the rings with the tag assemblies attached thereto. The tag assembly includes an elongated, rigid card and a flexible, tear resistant strap for securing the card to the ring shank. A first end of the card includes an enlarged shoulder portion, a neck portion and a seat portion having an arcuate seat for receiving the ring shank in abutting relation. The seat portion comprises two flexible fingers which extend upwardly and outwardly from the neck portion and cooperate to form the seat. In use, the fingers flex to conform to various diameters of ring shanks when received in abutting relation therewith. For attachment of the card to the ring shank, the strap is received through the shank of the ring and the first and second ends of the strap are secured to opposing surfaces of the card by means of pressure sensitive adhesive applied to the surfaces of the dumbbell strap. The adhesive makes a permanent bond that cannot be peeled off. Since the strap is tear resistant, and the adhesive is permanent, the card cannot be easily removed from the ring without the aid of scissors.

Furthermore, since the card is highly visible when a ring having the card attached thereto is worn by a potential purchaser, the chances of theft detection or prevention are greatly improved. Yet at the same time, a potential customer may try on a ring for size and appearance even though the card is attached to the ring shank as aforedescribed.

The display assembly for receiving the rings with the tag assemblies attached thereto includes a display pad having a plurality of spaced slots for receiving ring shanks and further includes a stand for supporting the slotted display pad in an elevated position above a supporting surface. In use, the elongated card is passed through one of the slots in the pad so that the ring shank is received in the slot in a conventional manner. It is noted that the stand has a depth which is greater than the length of elongated card so that the card can hang freely below the slotted pad when the ring shank is received in the slot. The display pad further includes a rigid backplate having a plurality of slots therein, wherein the slots have a width which is greater than the thickness of the card but less than the thickness of the shoulder so that the shoulder portion of the card is retained above the backplate. The rings are thus prevented from falling through the display pad into the interior of the stand where they are not visible for display or accessible for removal.

Accordingly, among the objects of the instant invention are: the provision of an anti-pilferage tag assembly for a finger ring which is attached to the ring shank and which cannot be easily removed from the finger ring; the provision of an anti-pilferage tag assembly including an elongated card which is highly visible when the ring is worn on a finger by a purchaser; the provision of a ring display system including an anti-pilferage tag assembly having an elongated card attached to the shank of the finger ring and further including a slotted display pad supported in an elevated tray for receiving the finger rings and for accommodating the elongated cards below the slotted pad; and the provision of a ring display assembly including an anti-pilferage tag assembly and an elevated display pad wherein the tag assembly engages a rigid backplate of the display pad to prevent the rings from slipping through the pad.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
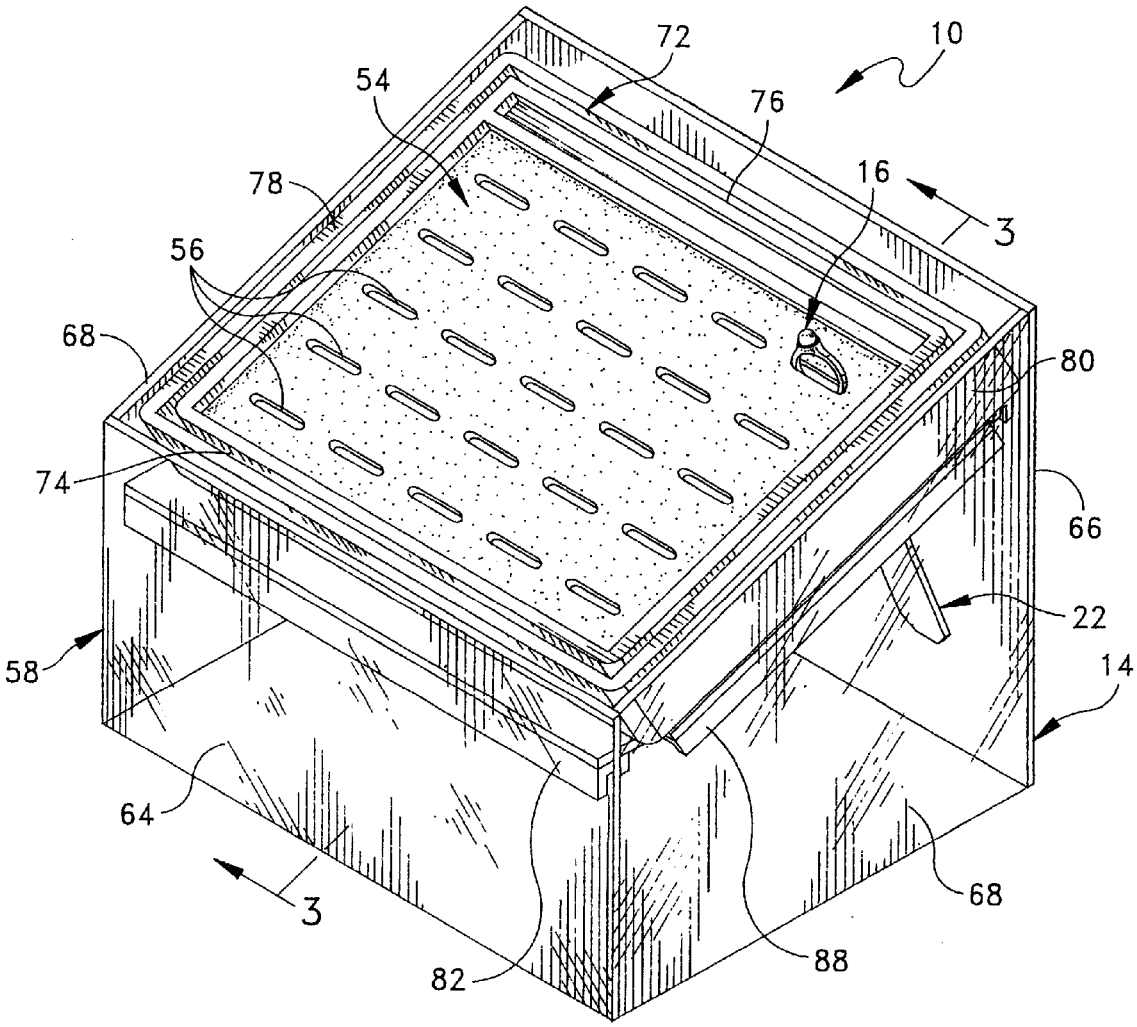
FIG. 1 is a perspective view of the ring display system of the instant invention.
Figure 2:
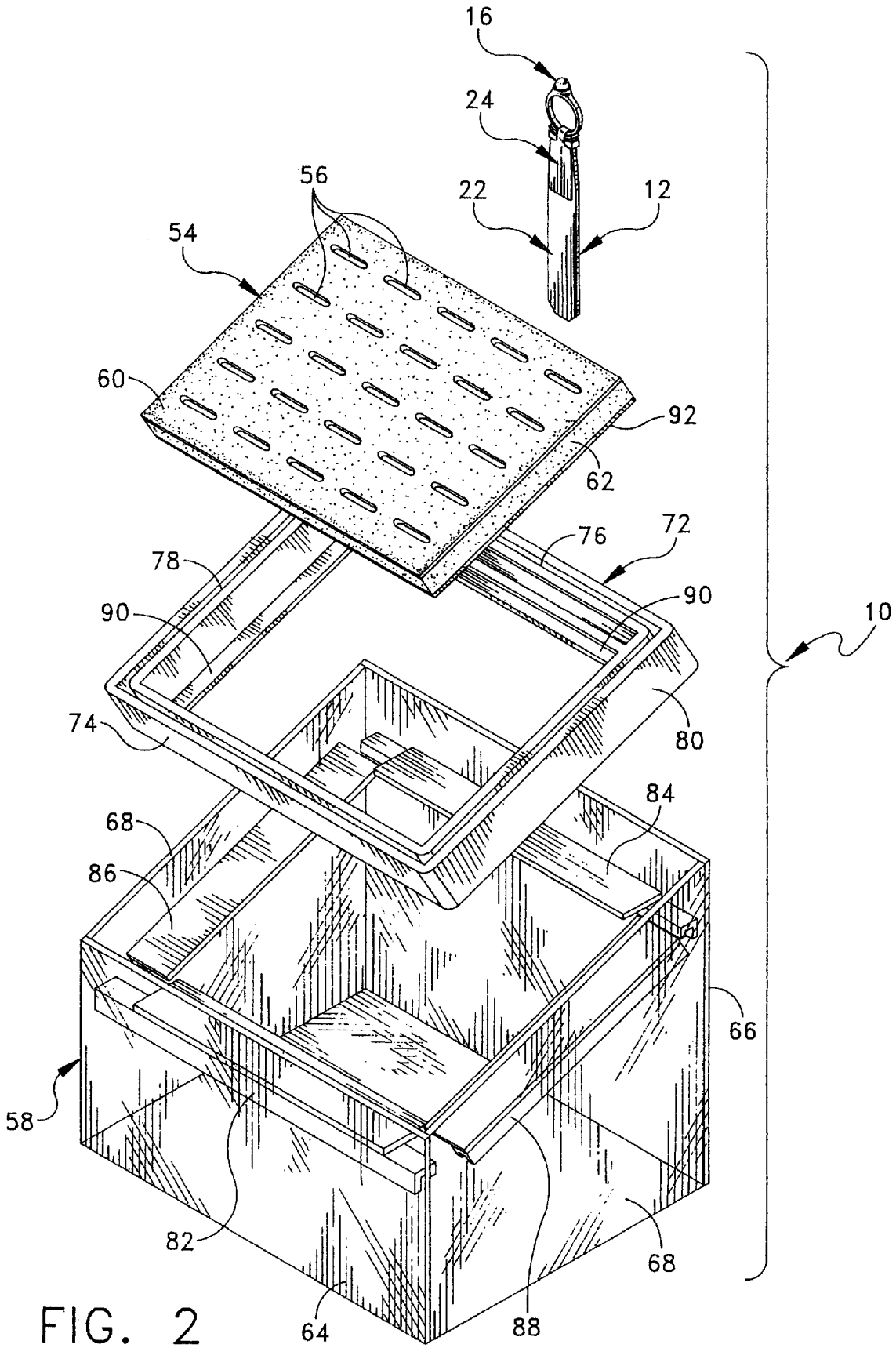
FIG. 2 is an exploded perspective view thereof.
Figure 3:
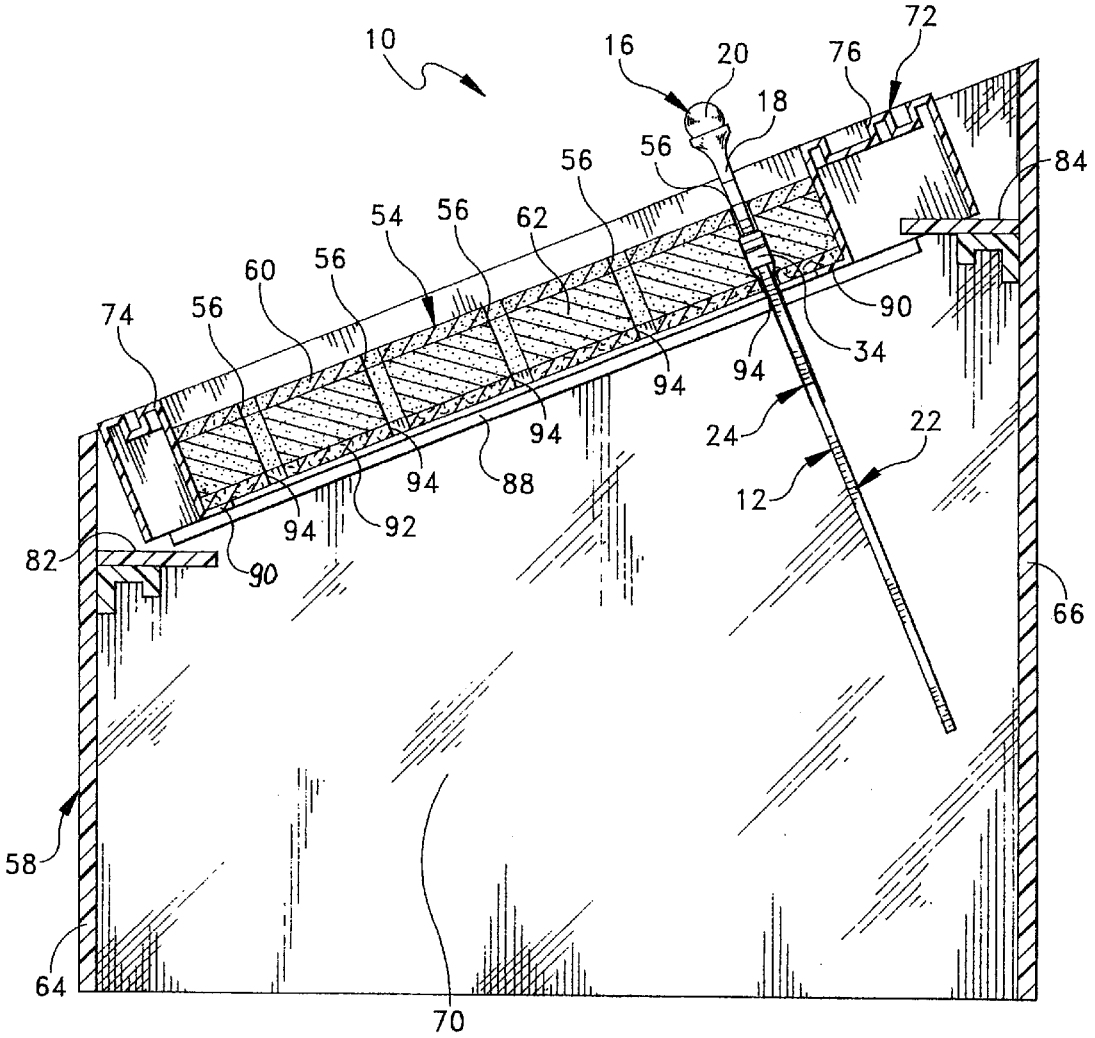
FIG. 3 is a cross-sectional view thereof taken along line 3—3 of FIG. 1.
Figure 4:
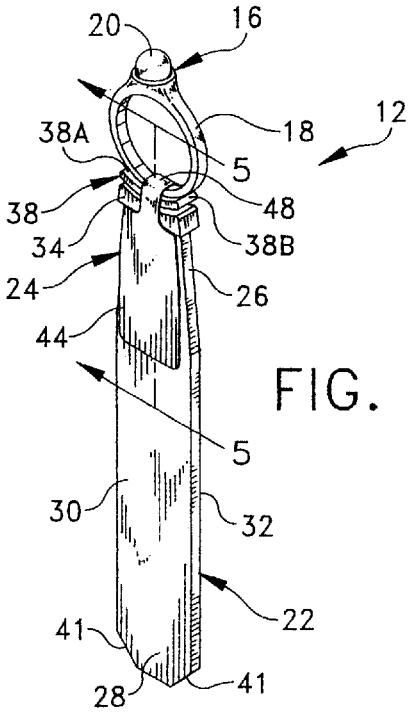
FIG. 4 is a perspective view of the anti-pilferage tag assembly of the instant invention.
Figure 5:
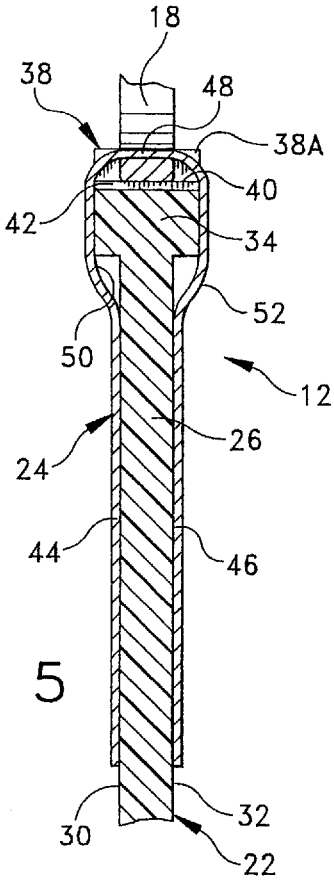
FIG. 5 is an enlarged fragmentary cross-sectional view thereof taken along line 5—5 of FIG. 4.
Figure 6:
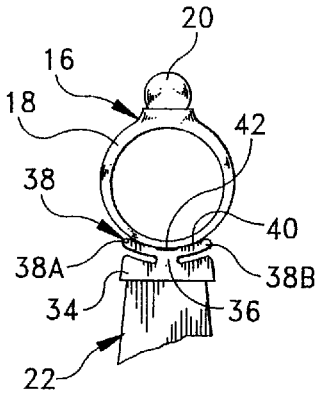
FIG. 6 is a fragmentary front view of the elongated card member of the anti-pilferage tag assembly with a small diameter ring shank mounted thereon.
Figure 7:
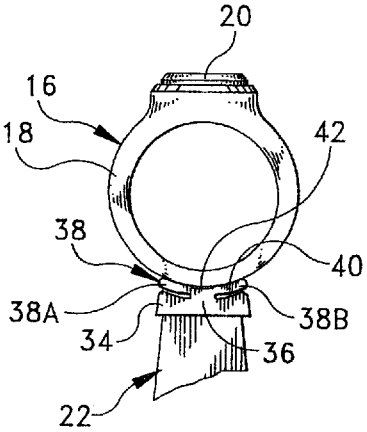
FIG. 7 is another fragmentary front view thereof with a larger diameter ring shank mounted thereon.

Referring now to the drawings, the ring display system of the instant invention is illustrated and generally indicated at 10 in FIGS. 1–3. As will hereinafter be more fully described, the instant ring display system 10 comprises an anti-pilferage tag assembly generally indicated at 12, and a display assembly generally indicated at 14 for receiving rings generally indicated at 16 with the tag assemblies 12 attached thereto. Rings 16 each include a circular shank portion 18 and an ornamental top portion 20.

Referring now to FIGS. 4–7, the tag assembly 12 comprises an elongated, rigid card generally indicated at 22 and a flexible, tear resistant strap generally indicated at 24 for securing the card 22 to the ring shank 18. The card 22 is preferably molded from a substantially rigid plastic material, such as Mylar. The card 22 includes first and second ends 26, 28 respectively, and first and second opposing surfaces 30,32 respectively, and preferably has a thickness of about 0.060 inch. The first end 26 of the card 22 includes an enlarged shoulder portion 34 having a thickness of about 0.135 inch, a neck portion 36 extending upwardly from the shoulder portion 34 and a seat portion generally indicated at 38 having an arcuate seat 40 for receiving a ring shank 18 in abutting relation. The second end 28 of card 22 is formed by tapered edges 41. More specifically, the seat portion 38 comprises two flexible fingers 38A, 38B which extend upwardly and outwardly from the neck portion 36 and cooperate to define seat 40. In use, the fingers 38A,38B flex downwardly to conform to various ring shank diameters (see FIGS. 6 and 7). In this connection, the seat portion is further provided with a central notch 42 to facilitate flexing of the arms 38A,38B.

The strap 24 is preferably stamped from a thin, yet flexible, tear resistant plastic, such as polyester or polyvinyl chloride (PVC) and preferably has a thickness of about 0.004 inch. In this regard, it has been found that the preferred thickness provides sufficient strength to the strap 24 so that it cannot be torn or severed without the aid of scissors. The strap 24 is preferably shaped so as to have two enlarged ends 44,46 and a narrow neck portion 48 connecting the enlarged ends 44,46. Attachment of the card 22 to the ring shank 18, which is received in the arcuate seat 40, is accomplished by extending the strap 24 through the ring shank 18 and securing the first and second ends 44,46 of the strap 24 to the opposing surfaces 30,32 of the card 22 (See FIG. 5). Attachment of the strap is preferably effected by means of a pressure sensitive adhesive applied to the inner side 50 (FIG. 5) of the strap 24 although other methods of attachment are also contemplated. The adhesive preferably comprises a permanent adhesive which makes a permanent bond with the card so that the strap cannot be peeled away. Since the strap 24 is relatively thin, the ring 16, with the card 22 attached thereto, can be tried on without interference. However, when the ring 18 is tried on by a potential purchaser, the elongated card 22 is highly visible and thus greatly increases the chances of theft detection or prevention. Printed information, such as style numbers, price, etc., for each of the rings 16, can be printed on either the outer surface 52 of the strap 24, or on the surfaces 30,32 of the card 22, or on paper panels (not shown) which can be attached to the cards 22.

Referring back to FIGS. 1–3, the display assembly 14 includes a display pad generally indicated at 54 having a plurality of spaced slots 56 for receiving the ring shanks 18 and further includes a stand generally indicated at 58 for supporting the display pad 54 in spaced relation above a supporting surface. The display pad 54 preferably includes a flocked or felt top surface 60 and an inner foam body 62. The slots 56, which extend through the top surface 60 and the foam body 62 preferably have a width of about 0.100–0.120 inches so that they easily receive various size ring shanks 18 and so that the card 22 is easily passed therethrough. The stand 58 is conventional in construction including a front wall 64, rear wall 66, and side walls 68 connected at their respective ends to define an upwardly opening interior cavity 70 (FIG. 3). The display assembly 14 further includes an annular tray generally indicated at 72 for receiving and supporting the display pad 54 in the stand 58. The tray 72 includes front, rear and side walls 74,76,78,80 which are supported in the interior 70 of the stand 58 adjacent the upper edge thereof by shoulders 82,84,86,88 which extend inwardly from the four walls 64,66,68. The upper edge of the rear wall 66 is higher than the upper edge of the front wall 64 so as to support the display pad 54 at a desirable viewing angle. The inner lower edges of the tray walls 74,76,78,80 include an inwardly extending flange 90 for supporting the peripheral edge of the display pad 54 therein.

In use (see FIG. 3), the elongated card 22 (0.060 inch thick) is passed through one of the slots 56 (0.0100–0.0120 inch wide) in the pad 54 so that the ring shank 18 is received in the slot 56 in a conventional manner (See FIGS. 1 and 2), i.e. with the ornamental top portion 20 projecting above the top of the pad 54. The tapered edges 41 of the card 22 facilitate insertion of the card 22 into the slots 56. In this regard, it is pointed out that the interior cavity 70 of the stand 58 has a depth which is greater than the length of the elongated card 22 so that the card 22 can hang freely below the display pad 54 when the ring shank 18 is received in the slot 56.

The display pad 54 further includes a rigid backplate 92 having corresponding slots 94 therein. The slots 94 have a width of about 0.100–0.120 inches, said width being greater than the thickness of the card (0.060 inch) so that the card easily passes therethrough. However the shoulder portion 34 at the first, or upper, end 26 of the card 22 has a width (0.135) that is greater than the width of the slot 94 so that the shoulder 34 engages the backplate 92 and is retained above the backplate 92. The rings 16 are thus prevented from sliding downwardly into the interior 70 of the stand 58 where they unavailable for viewing.

It can therefore be seen that the instant invention provides an effective ring display system 10 which reduces pilferage of finger rings 16 yet provides a simple and attractive display. An anti-pilferage tag assembly 12 includes an elongated card 22 which is securely attached to the ring shank 18 by a thin yet tear resistant strap 24. The card 22 attached to the ring shank 18 makes the ring 16 highly visible when tried on by a potential purchaser thus reducing the chances of pilferage. Since the strap 24 is tear resistant, the elongated card 22 cannot be easily removed from the ring 16, further reducing the chances of pilferage. The display system 10 further includes a display assembly 14 including an elevated display pad 54 for receiving the rings 16 with the cards 22 attached thereto. The cards 22 are received through slots 56 in the pad 54 so that the rings 16 are received therein in a normal manner. In this regard, the pad 54 is supported above a supporting surface by a stand 58 having a sufficient depth so that the cards 22 can hang freely beneath the display pad 54 when the rings are received in the slots 56. Since the cards 22 are maintained below the surface of the display pad 54, the display system 10 provides a very neat appearance, the prior problem of stray dumbbell tags projecting up from the slots having been eliminated. In order to prevent the rings 16 from passing completely through the display pad 54, the display pad 54 includes a rigid backplate 92 with slots 94 in registry with the pad slots 56, and the card 22 includes an enlarged shoulder portion 34 adjacent its upper end 26. The enlarged shoulder 34 has a thickness which is greater than the width of the slot 94 so that the shoulder 34 engages the backplate 92 and is retained above the backplate 92. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

We claim:

1. An anti-pilferage ring display system comprising:

a tag assembly including an elongated, substantially rigid, planar card having first and second ends and opposing surfaces, a flexible, tear resistant strap for securing said first end of said card member to a ring, said strap being constructed and dimensioned for receipt through a shank of the ring and further including means for securing first and second ends of said strap to said opposing surfaces of said card member; and a display assembly comprising a display pad having a plurality of spaced slots for receiving the ring shanks and further comprising a stand for supporting said slotted pad above a supporting surface, said card member being received through said slot so that the shank is captured in said slot, said card member being received below said display pad.

2. The ring display system of claim 1 wherein said stand has a depth which is greater than the length of said elongated card member so that said card member can hang freely below said slotted pad when the ring shank is received in said slot.

3. The display assembly of claim 1 wherein said first end of said card member includes an enlarged shoulder and a seat for receiving said ring shank, said slotted display pad including a rigid backplate having a plurality of slots in registry with said slots in said display pad, said slots in said backplate having a width which is greater than a thickness of said card member and less than a thickness of said shoulder wherein said shoulder engages said backplate and is retained above said backplate.

4. An anti-pilferage ring display system for displaying a jewelry article having a circular shank comprising:

a display assembly including a display pad having a plurality of spaced slots for receiving the shank of the jewelry article and further comprising a stand for supporting said display pad above a supporting surface;

a tag assembly including an elongated, substantially rigid card member having a first end and a second end and opposing surfaces, a flexible, tear resistant strap secured to said card member at said first end and constructed and arranged for receipt through the shank of the jewelry article such that the shank of the jewelry article is held in tight abutting relation with said first end of said card member; and wherein said card member is constructed and dimensioned for receipt through said plurality of spaced slots so that said card member extends below said display pad and the shank of the jewelry article is captured in said slot.

5. The ring display system of claim 4, wherein said stand has a depth which is greater than the length of said elongated card member so that said card member will hang freely below said display pad when the shank of the jewelry article is captured in said slot.

6. The display assembly of claim 4, wherein said first end of said card member includes an enlarged shoulder and a seat portion for receiving said shank in abutting relation.

7. The display assembly of claim 6, wherein said display pad includes a rigid backplate having a plurality of slots in registry with said plurality of slots in said display pad, said plurality of slots in said backplate having a width which is greater than a thickness of said card member and less than a thickness of said shoulder, wherein upon receipt of said card member through said plurality of slots in said backplate said shoulder engages said backplate and is retained above said backplate.

8. An anti-pilferage tag assembly for a jewelry article having a circular shank for display within a display assembly, the anti-pilferage tag assembly comprising:

an elongated, substantially rigid card member constructed and dimensioned to be received within a slot disposed within the display assembly, said card member including a first end having a seat portion with an arcuate surface for receiving the circular shank of the jewelry article in abutting relation thereon; and a flexible, tear resistant strap secured to said card member at said first end and constructed and arranged for receipt through the shank of the jewelry article such that the shank of the jewelry article is held in tight abutting relation with said seat portion.

9. The tag assembly of claim 8, wherein said seat portion includes a neck portion extending from said first end, and two opposed fingers extending outwardly and upwardly from said neck portion, said fingers being flexible so as to conform to the shank when the shank is received thereon.

10. The tag assembly of claim 8, wherein said strap includes a first end and a second end for securing said strap to said card member.

11. The tag assembly of claim 10, wherein said first end and said second end are secured to opposing surfaces of said card member at said first end.

12. The tag assembly of claim 10, wherein said first end and said second end are secured to the opposing surfaces by a self-sticking adhesive.

13. The tag assembly of claim 10, wherein said first and second ends are connected by a neck.

* * * * *